United States Patent [19]

Hansen

[11] Patent Number: 4,804,227

[45] Date of Patent: Feb. 14, 1989

[54] POINT-SYNCHRONIZED ADJUSTMENT DEVICE FOR OFFICE CHAIRS

[75] Inventor: Eckhard Hansen, St. Margrethen, Switzerland

[73] Assignee: Ahrend-Cirkel B.V., Zwanenburg, Netherlands

[21] Appl. No.: 132,314

[22] Filed: Dec. 14, 1987

[51] Int. Cl.[4] ..... A47C 3/00

[52] U.S. Cl. ..... 297/301; 297/300; 297/316; 297/353

[58] Field of Search ..... 297/301, 294, 295, 285, 297/300, 353, 316

[56] References Cited

U.S. PATENT DOCUMENTS

| | | | |
|---|---|---|---|
| 2,365,200 | 12/1944 | Lorenz | 297/301 X |
| 3,525,549 | 8/1970 | Knabusch | 297/353 X |
| 4,451,085 | 5/1984 | Franck et al. | 297/300 X |
| 4,502,729 | 3/1985 | Locher | 297/300 X |
| 4,685,733 | 8/1987 | Machate | 297/301 X |
| 4,711,491 | 12/1987 | Ginat | 297/301 |

FOREIGN PATENT DOCUMENTS

| | | | |
|---|---|---|---|
| 164266 | 12/1985 | European Pat. Off. | 297/316 |
| 3436964 | 4/1986 | Fed. Rep. of Germany | 297/300 |
| 1241452 | 8/1960 | France | 297/285 |

*Primary Examiner*—Kenneth J. Dorner
*Assistant Examiner*—Laurie K. Cranmer
*Attorney, Agent, or Firm*—Young & Thompson

[57] ABSTRACT

A reclining chair is provided comprising a seat (2) comprised of a rigid supporting shell (7), a back rest (3) freely displaceable in orientation in relation to said seat (2), a rigid seat support (18,9) including at a forward end of the seat a stationary pivot axis (8) where said rigid supporting shell (7) is attached to said rigid seat support (18,9) and about which pivot axis said seat can pivot rearwardly into a reclining position, at least one back stay bar (11), one end (12) of said back stay bar being fixed to said seat support (18,9), and an opposing end (16) of said back stay bar being connected to said back rest (3), and said seat shell (7) including a slide bearing (20), a portion of said back stay (11) being slidably supported on said slide bearing (20), said slide bearing providing positive guidance between the seat shell and the back stay such that when said seat shell reclines over an angle $\beta$ the back rest reclines over an angle $\alpha$ which is substantially greater than angle $\beta$.

5 Claims, 1 Drawing Sheet

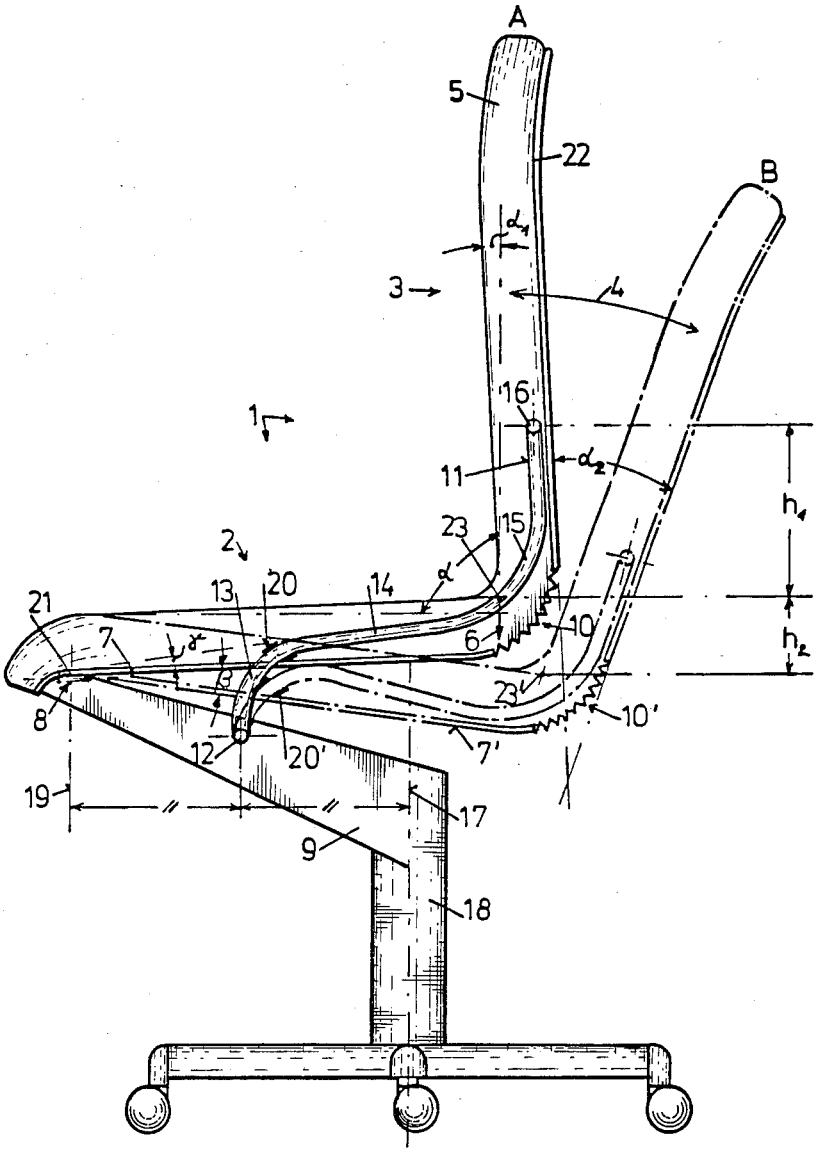
A
B
5
22
3
1
16
11
2
23
15
21
13
20
14
7
6
10
8
12
20'
23'
10'
7'
19
17
9
18
h1
h2

POINT-SYNCHRONIZED ADJUSTMENT DEVICE FOR OFFICE CHAIRS

The invention relates to a point-synchronized adjustment device for office chairs, seating furniture or the like in accordance with tehprecharacterising clause of claim 1.

In office chair construction, a synchronized mechanism is taken to mean the provision of combined back adjustment and seat adjustment, i.e. adjustment of the inclination of the back results fundamentally also in an adjustment of the inclination of the seating surface. Due to the increase in the angle as the inclination of the back increases a linear extension occurs between the seating surface and the back part between the seat contact point and the point of contact with the back. Since, in such seating furniture, the inclination of the back can be subject to constant variation, there is constant displacement between the seat contact point and the point of contact with the back, with the result that the clothing of the seated person is constantly displaced. This is known as the "shirt pull-out effect".

In order to remove this disadvantage, DE-A1 35 20 188 discloses a point-synchronized mechanism for office chairs, in which the adjustment in the angle between the back part and the seating surface takes place in such a manner that the arc through which the back of the person moves is identical to the arc decribed by the back rest as its inclination is adjusted. During this procedure, the adjustment of the back rest causes an almost concentric rotation about an imaginary transverse axis through the hip region of the seated person. By this means it is possible to prevent the troublesome lengthwise displacement between the seating surface and the point of contact with the back. To achieve this, the mechanism must be constructed such that the downward movement of the seat plate and the simultaneous increase in the inclination of the back rest creates a virtually rigid connection without any alteration in the lengthwise distance between the seat and the back rest, so that the point at which the back of the seated person contacts the chair performs the same rotational movement as the chair itself.

The required positive interlink between the inclination of the seat and the inclination of the back must here be chosen to be such that the amount by which the seat is lowered is less than the corresponding amount by which the back is lowered, i.e. the inclination of the seating surface is altered less than the inclination of the back. As a rough rule of thumb for this, the angle of inclination of the seat is assumed to be twice that of the inclination of the back. When the angle of the back rest is adjusted backwards by about 20° out of the normal position, the inclination and hence the lowering of the seating surface near the back must accordingly be about 10°. The point of support for the back here executes a downward movement of about 7 cm.

The known chair mechanisms have the disadvantage of a relatively complicated mechanical design. Thus a large number of articulation points are necessary in order to bring about the desired movement of the back rest and/or the seat shell.

The object of the invention is to develop further a point-synchronized adjustment device for office chairs, seating furniture or the like of the type mentioned at the outset in such a way that an extremely simple mechanism brings about the desired effect. At the same time, the synchronized adjustment mechanism should create the desired positive interlink between the adjustment of the inclination of the back and the adjustment of the inclination of the seat.

This object is achieved according to the invention starting from a point-synchronized adjustment device of the type mentioned at the outset in that positive guidance is provided between the lower seat shell region and the back stay or stay bar by a support bearing in the form of a connecting link guide, the connecting link guide counteracting the lowering of the seat shell or inclination of the seat part about the pivot point at the front articulation point.

Advantageous and expedient further developments of the device according to the invention are described in the subclaims.

An office chair having a seat shell which continues through to the back part or having a separate seat shell has a first bearing at the front end of the seat at the seat bracket. If a seat shell of this kind is inclined backwards, the ratio which establishes itself between the inclination of the back and the inclination of the seat is 2:1. The same applies if an additional S-shaped or Z-shaped back stay or stay bar is introduced which, on the one hand, is attached with a fixed pivot point at the seat bracket and at the seat part so as to carry out a downward movement and, on the other hand, with a fixed bearing or pivot bearing in the back rest. In this case, when an inclination of the back is carried out, an equally large inclination of the seat also occurs, i.e. the ratio of the inclination of the back to the amount by which the seat is lowered is likewise 2:1. The above applies to continuous or separate seat shells.

According to the invention, an additional connecting link support bearing is incorporated between the lower seat part, referred to below as "seat shell", and the stay bar or back stay. This bearing is designed and arranged such that the lowering of the seat region can be less than would normally be brought about by the inclination of the back part. According to the invention, this is brought about by a type of connecting link guidance between the stay bar and the seat shell. The known point-synchronized mechanism is thereby created using very simple means.

An advantageous and expedient exemplary embodiment of the invention is illustrated in the drawing and explained in more detail in the description which follows.

The chair (1) shown in the figure comprises a seat part (2) and a back part (3). In seating furniture with synchronized adjustment, an adjustment (arrow 4) in the inclination of the back rest (5) is associated with a simultaneous downward movement (arrow 6). The adjustment of the back rest is normally by about $\alpha_1 = 5°$ forwards and about $\alpha_2 = 15°-20°$ backwards.

In the figure, the inclination at which the seat is lowered is designated $\beta = 8°-10°$. In the front region, the seat shell (7) is attached to the seat bracket (9) at the articulation point (8). The articulation point is designed as a pivot bearing (8). Insofar as the seat part in the region of the articulation point is designed as a flexible bending zone, the articulation point (8) can be made rigid.

In the region between the lower seat shell (7) and the back part (3), the seat, which is composed of the seat part (2) and the back part (3) has a bending zone (10). This bending zone is necessary in order to achieve a differential inclination as between the seat part (2) or seat shell (7) and the back part (3). However, the seat part (2) and the back part (3) can also take the form of separate parts.

The mechanical connection between the seat bracket (9) and the back part (3) is provided by the back stay (11).

In the illustrative embodiment, the back stay (11) is designed as an S-shaped or Z-shaped stay bar (11), two stay bars (11) being arranged in each case in the lateral region of the chair. The back stay or stay bar (11) is articulated at the seat bracket (9) by means of a fixed pivot bearing (12) and curves initially in the form of an arc (region 13), then almost parallel to the seat shell (7) or at an acute angle $\gamma$ to the latter into the seat part (2) (region 14), before again curving in an arc shape (region 15) into the back part (3). The vertex (21) of the angle $\gamma$ begins approximately in the region of the articulation point (8). In the back part (3), the back stay or stay bar (11) is fixed by means of a fixed bearing (16) or pivot bearing. If a fixed bearing (16) is chosen, a continuous seat shell (7), which continues in the seat part (2) and back part (3) and has a seat shell back part (22) is used, utilizing its intrinsic flexibility. The bearing (16) is located at a height ($h_1$) approximately in the region of a seated person. The pivot bearing (12) is located at an approximately central point between the longitudinal axis (17) of the chair pedestal (18) and the vertical axis (19) through the articulation point (8).

If, in the embodiment described, the inclination of the back part (3), were to be adjusted according to arrow 4, the seat shell (7) would drop by almost the same angle $\beta$ which would correspond to the change in inclination $\alpha_2$. This also applies where the seat part (2) and the back part (3) are designed as separate parts, the presence of a rigid joint connection between seat part (2) and back stay (11) being necessary in this case to generate the desired synchronized movement and thereby pull the seat downwards at the same time. This connection mechanism is shown in DE-A1 35 20 188.

Now according to the invention, the seat part (2) is provided with a different movement by arranging a separate support bearing (20) between the seat shell (7) and the back stay or stay bar (11). In the exemplary embodiment, this bearing is designed as a kind of carry-along bearing, i.e. the downward movement of the stay bar (11) acts directly on the seat shell (7) via the bearing (20). In the exemplary embodiment, the support bearing (20) is designed as a sliding bearing in the form of a passage through the lower region of the seat shell (7). Of course, any type of connecting link guide can be used to force the seat shell (7) to carry out a controlled movement while preserving the correct angle ratio between the inclination of the seat and the inclination of the back rest, as the back stay or stay bar (11) moves downwards. The figure shows the adjustment in inclination from a starting position (position A) to an inclined position (position B). In this case, the support bearing (20) travels into the region (20'), i.e. as the stay bar (11) moves downward, the bearing (20), which is fixed to the seat shell (7), slides towards the pivot bearing (12), in the process sliding along the arc-shaped region (13) of the stay bar (11). If a connecting link guide were to be selected instead of the sliding bearing (20), the relative movement between the seat shell and the stay bar in a connecting link guide would have to be chosen such that the desired functional relation between the inclination of the seat surface and the inclination of the back established itself. The backward movement of the seat part (2) (arrow 6) which occurs during this movement is indicated in the figure by ($h_2$) over the chosen point (23 or 23'). The invention is not restricted to the exemplary embodiment; on the contrary, it also encompasses all expert modifications and further developments of the principle of the invention. In particular, the shape of the back stay or stay bar (11) and hence the movement of the stay bar in the support bearing (20), which is fixed to the seat shell (7), can be varied in order, by the variation, to achieve the desired functional relation in the synchronized mechanism. Of decisive importance is the connecting link guide between the back stay or stay bar (11) and the seat shell (7), in particular in the form of the arc-shaped movement (region 13) caused by the sliding movement of the carry-along bearing (20) on the stay bar (11).

Several modifications and additions are possible within the scope of the present invention.

Inside the seat bracket 9 a coil spring mechanism may be mounted to offer an adjustable resistance against a backwards tilting of the back part.

To enable a person to select the desired sitting height, the chair could be provided with a gas spring mechanism known per se.

Obviously a locking mechanism could be added to lock a selected inclination position of the back part 3. This mechanism could have a setting indicator to indicate the inclination in degrees.

The front portion of the seat part may be tiltable downwards in two or more positions to adapt the length of the seat part to persons with shorter or longer upper legs.

I claim:

1. A reclining chair comprising a seat (2) comprised of a rigid supporting shell (7), a back rest (3) freely displaceable in orientation in relation to said seat (2), a rigid seat support means (18,9) including means defining at a forward end of the seat a stationary pivot axis (8) where said rigid supporting shell (7) is attached to said rigid seat support means (18,9) and about which pivot axis said seat can pivot rearwardly into a reclining position, at least one back stay bar (11), one end (12) of said stay bar being fixed to said seat support means (18,9) at pivot axis (12) positioned rearwardly of pivot axis (8), and an opposing end (16) of said back stay bar being connected to said back rest (3), said back stay bar passing through said supporting shell (7), and said seat shell (7) including a slide bearing means (20), a portion of said back stay (11) being slidably supported on said slide bearing means (20), said slide bearing means providing positive guidance between the seat shell and the backstay such that when said seat shell reclines over an angle $\beta$ the back rest reclines over an angle $\alpha$ which is substantially greater than angle $\beta$.

2. The reclining chair of claim 1 wherein said back stay bar is substantially S-shaped.

3. The reclining chair of claim 2 wherein said slide bearing means comprises a curved guide for said back stay bar as it extends through said supporting shell (7).

4. The reclining chair of claim 1 wherein said rigid seat support means (18,9) comprises a vertically oriented pedestal (18) and a supporting seat bracket (9) extending laterally therefrom.

5. The reclining chair of claim 1 wherein one end of said back stay bar extends upwardly into said back rest (3) and the opposing end extends along and through said supporting shell (7) and is attached to said rigid seat support means (18,9).

* * * * *